US008146169B2

(12) United States Patent
Marchesi

(10) Patent No.: US 8,146,169 B2
(45) Date of Patent: Apr. 3, 2012

(54) CLOTHING ENDOWED WITH BULLETPROOF AND KNIFE-PROOF PROPERTIES

(76) Inventor: Fabio Massimo Marchesi, Lucangeli (IT)

( * ) Notice: Subject to any disclaimer, the term of this patent is extended or adjusted under 35 U.S.C. 154(b) by 1128 days.

(21) Appl. No.: 11/820,108

(22) Filed: Jun. 18, 2007

(65) Prior Publication Data

US 2008/0155737 A1 Jul. 3, 2008

(51) Int. Cl.
*F41H 1/02* (2006.01)

(52) U.S. Cl. ..... 2/2.5; 2/463

(58) Field of Classification Search ..... 2/2.5, 455, 2/466, 465, 463, 459, 468; 442/208
See application file for complete search history.

(56) References Cited

U.S. PATENT DOCUMENTS

| | | | | | |
|---|---|---|---|---|---|
| 1,348,204 | A | * | 8/1920 | Brewster | 2/2.5 |
| 1,350,062 | A | * | 8/1920 | Brewster | 2/2.5 |
| 3,916,448 | A | * | 11/1975 | Hamel | 2/2.5 |
| 4,241,457 | A | * | 12/1980 | Klein et al. | 2/2.5 |
| 4,425,667 | A | * | 1/1984 | Harrison | 2/462 |
| 4,522,871 | A | * | 6/1985 | Armellino et al. | 442/135 |
| H000007 | H | * | 1/1986 | Martone | 2/2.5 |
| 4,660,223 | A | * | 4/1987 | Fritch | 2/2.5 |
| 4,677,696 | A | * | 7/1987 | Tanaka | 2/84 |
| 5,060,314 | A | * | 10/1991 | Lewis | 2/2.5 |
| 5,127,896 | A | * | 7/1992 | de Gaston | 600/20 |
| 5,167,876 | A | * | 12/1992 | Lem et al. | 252/602 |
| 5,327,811 | A | * | 7/1994 | Price et al. | 2/2.5 |
| 5,644,797 | A | * | 7/1997 | Daneshvar | 2/161.7 |
| 5,729,832 | A | * | 3/1998 | Grilliot et al. | 2/23 |
| 5,738,925 | A | * | 4/1998 | Chaput | 428/101 |
| 5,754,982 | A | * | 5/1998 | Gainer | 2/2.5 |
| 5,966,747 | A | * | 10/1999 | Crupi et al. | 2/466 |
| 5,996,115 | A | * | 12/1999 | Mazelsky | 2/2.5 |
| 6,182,288 | B1 | * | 2/2001 | Kibbee | 2/2.5 |
| 6,266,818 | B1 | * | 7/2001 | Howland et al. | 2/2.5 |
| 6,543,055 | B2 | * | 4/2003 | Howland et al. | 2/2.5 |
| D475,812 | S | * | 6/2003 | Kalaam et al. | D29/100 |
| 6,698,024 | B2 | * | 3/2004 | Graves et al. | 2/2.5 |
| 6,745,394 | B1 | * | 6/2004 | Rutherford | 2/2.5 |
| 6,804,829 | B2 | * | 10/2004 | Crye et al. | 2/6.6 |
| 6,805,519 | B1 | * | 10/2004 | Courtney | 405/185 |
| 6,892,392 | B2 | * | 5/2005 | Crye et al. | 2/2.5 |
| 7,261,945 | B2 | * | 8/2007 | Biermann et al. | 428/469 |
| 7,266,850 | B1 | * | 9/2007 | Strum et al. | 2/2.5 |
| 7,571,493 | B1 | * | 8/2009 | Purvis et al. | 2/2.5 |
| 2001/0029621 | A1 | * | 10/2001 | Howland et al. | 2/2.5 |
| 2005/0166303 | A1 | * | 8/2005 | Aaron | 2/422 |
| 2005/0193459 | A1 | * | 9/2005 | Field et al. | 2/2.5 |
| 2007/0017138 | A1 | * | 1/2007 | Young | 42/71.01 |
| 2007/0028339 | A1 | * | 2/2007 | Carlson et al. | 2/2.5 |
| 2008/0098500 | A1 | * | 5/2008 | Matic et al. | 2/2.5 |
| 2008/0134419 | A1 | * | 6/2008 | Kalaam et al. | 2/463 |
| 2009/0064385 | A1 | * | 3/2009 | Crossman et al. | 2/6.6 |

* cited by examiner

*Primary Examiner* — Khoa Huynh
*Assistant Examiner* — Richale Quinn
(74) *Attorney, Agent, or Firm* — Thomas R. Vigil

(57) ABSTRACT

The clothing is designed to prevent medical workers after using needles on patients who may be suffering from infective pathologies transmissible via blood. A protective element comprises, at the time of production and shipping, a first portion and a second portion reciprocally constrained by a connecting element moulded contemporaneously with the two portions. A pan is created inside the first portion and first ridges and second ridges have been created in the lower part of the second portion.

10 Claims, 5 Drawing Sheets

CLOTHING ENDOWED WITH BULLETPROOF AND KNIFE-PROOF PROPERTIES

TECHNICAL FIELD

The present invention relates to clothing with bulletproof and knife-proof properties.

BACKGROUND ART

For some time now various types of protection have been designed and realized for the human body against the harmful and above all lethal effects deriving from cutting and sharp bodies in general.

When, in the present invention, the term 'protection' is used, it refers to ballistic protection determined on the basis of tests conducted taking into account the United States' NIJ specifications (which take into consideration the definition of the ammunition, weight of the bullet, the minimum speed required to effect the test). On the basis of these specifications, for example, protection class I is the lowest, with the speed of the bullet as it leaves the weapon registering 259-320 m/sec., class III envisages a bullet speed of 426 m/sec, up to class IV, in which the speed of the bullet is approximately 870 m/sec.

The currently known embodiments are all based on the general concept of a garment wearable like a vest bearing, both at the front and the rear, a plate realized generally with ceramic material suitable to constitute the barrier element against the penetration of bullets and blades.

The plates utilized until now have dimensions of approximately 18 cm×18 cm, and these measurements are due, basically, to two reasons: first of all, it is necessary to limit the weight of the vest and secondly, but not less importantly, the need to not hinder the movements of the person protected, particularly the movements for bending over forwards and crouching down.

From this limited surface of the plates realized until now there has arisen a first drawback, constituted of the narrowness of the protected zone, both at the front and rear.

It should also be noted that the protection devices currently realized, if divested of the plate, do not offer any type of effective protection, performing, in the end, like normal items of clothing, either because they are realized with fabrics which, intrinsically, do not possess any protective power or because, even if realized with Kevlar®, which has intrinsic bulletproof properties, they leave vast areas of the body uncovered, such as the lateral portions of the bust. This constitutes a further drawback presented by the bulletproof and knife-proof vests realized until now.

Said plates currently utilized are realized generally with ceramic materials and this leads to the drawback of their heavy weight and, also for this reason, as mentioned earlier, they present rather limited dimensions.

A further drawback of the currently known embodiments of bulletproof and knife-proof vests consists in the fact said vests are realized making wide use of seams; since the seams pass through the entire thickness of the vest following a single plane essentially orthogonal to the external surface of said vest, these present the drawback of constituting a penetration way for bullets and knives. And the stitching system with which the majority of known vests are realized, in order to augment their rigidity, present the aforesaid drawback of the presence of the seams, in fact it could rightfully be claimed that the stitching, because of the high number of seams necessary for its realization, amplifies considerably the risk of penetration of the shots/stabs.

It should also be noted that the embodiments of personal protection realized until now generally envisage vests only and, the only additional protective elements envisaged are an element for protecting the neck and the nape and pelvic protection, square in form, which, in general, presents the drawback that said protection limits the wearer's movements.

DISCLOSURE OF INVENTION

The aim of the present invention is to produce clothing complete with bulletproof and knife-proof properties capable of overcoming all the drawbacks mentioned above and, contemporaneously, capable of permitting extensive modularity among the various protective components.

In particular, the clothing endowed with bulletproof and knife-proof properties of the type realized by means of the employment of Kevlar® synthetic fiber together with the armor plates in question in the present invention, is characterized by the fact that it is constituted of:

- a vest element fitted with two armor plates, one at the front and one at the rear, and fitted with a lateral extension of the vest which also continues in correspondence with the lateral portions of the bust; said element also being fitted with two protrusions, each one positioned in correspondence with a shoulder, said vest element having a single seam line;
- a pant element, said element being endowed with a single seam for each leg;
- a protective element (4) composed of a front portion (4*a*) to protect the ventral and genital zone and a rear portion (4*b*) to protect the sacrum-lumbar zone;
- a neck/nape zone protective element that can be constrained to a helmet;
- protective elements for the hand zone;
- protective elements for the foot zone fitted with armor plates in at least one first sector which coves and wraps the foot;

and the fact that the layer of Kevlar® fabric is subdivided into several groups of pluralities of layers; said elements of clothing constitute a modular clothing system as they can all be used contemporaneously or only partially, depending on the different operative requirements.

These and other characteristics will better emerge in the description that follows of a preferred embodiment shown, purely in the form of a non-limiting example, in the drawings enclosed, in which.

Figure 5:
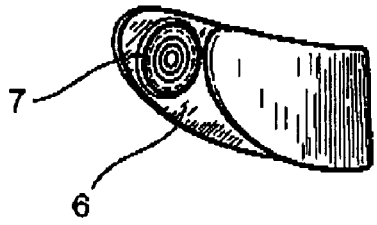
FIG. 5 shows a protective element for neck/nape zone according to the present invention.
Figure 5A:
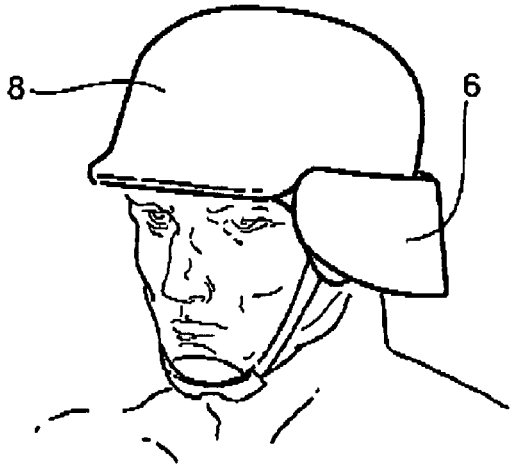
Figure 5B:
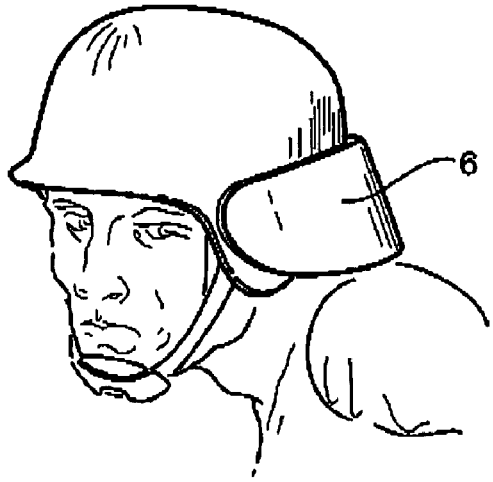
Figure 5C:
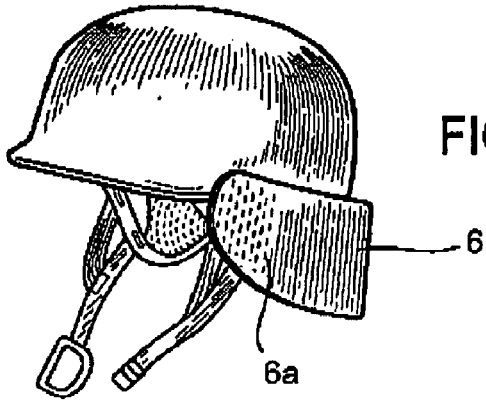
Figure 7:
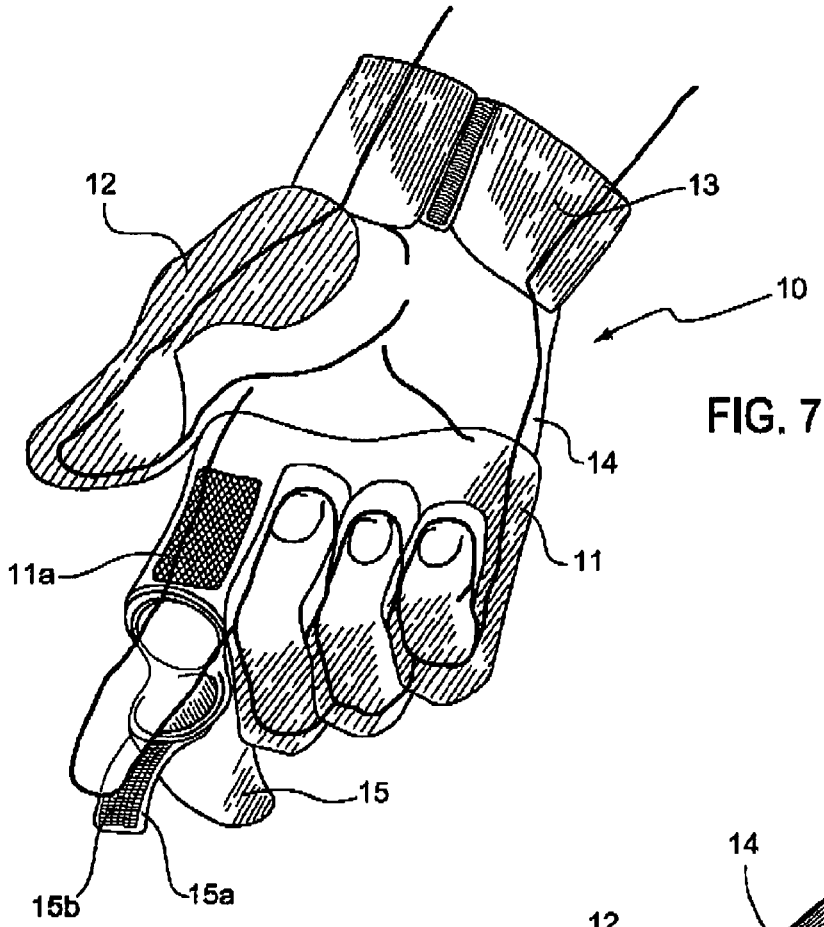
Figure 6:
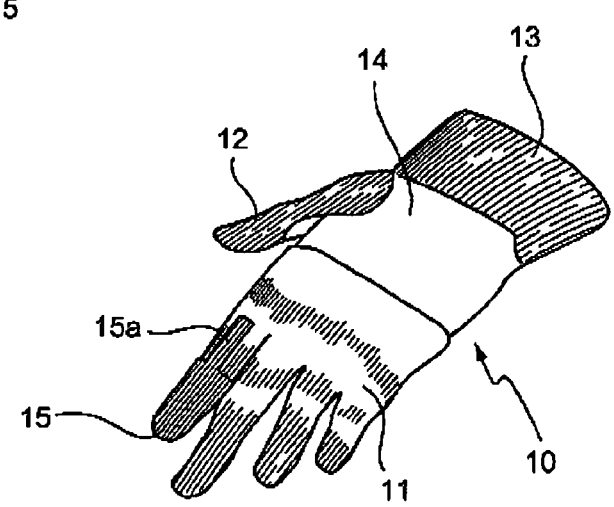
Figure 8:
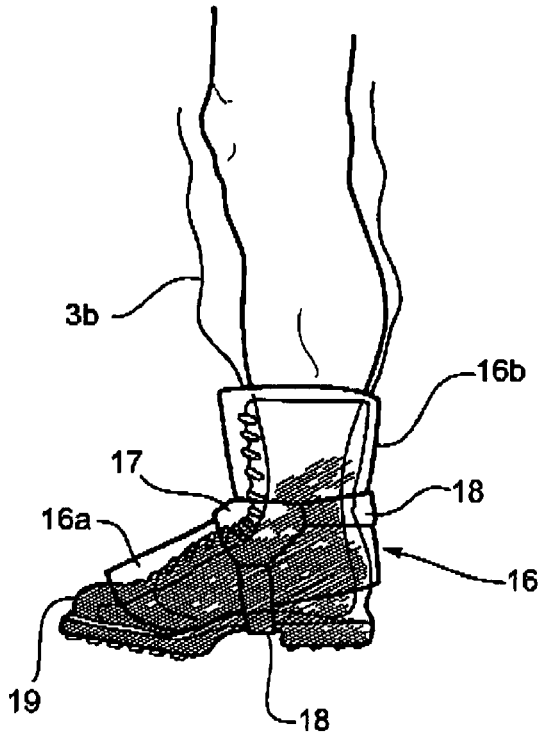
Figure 9:
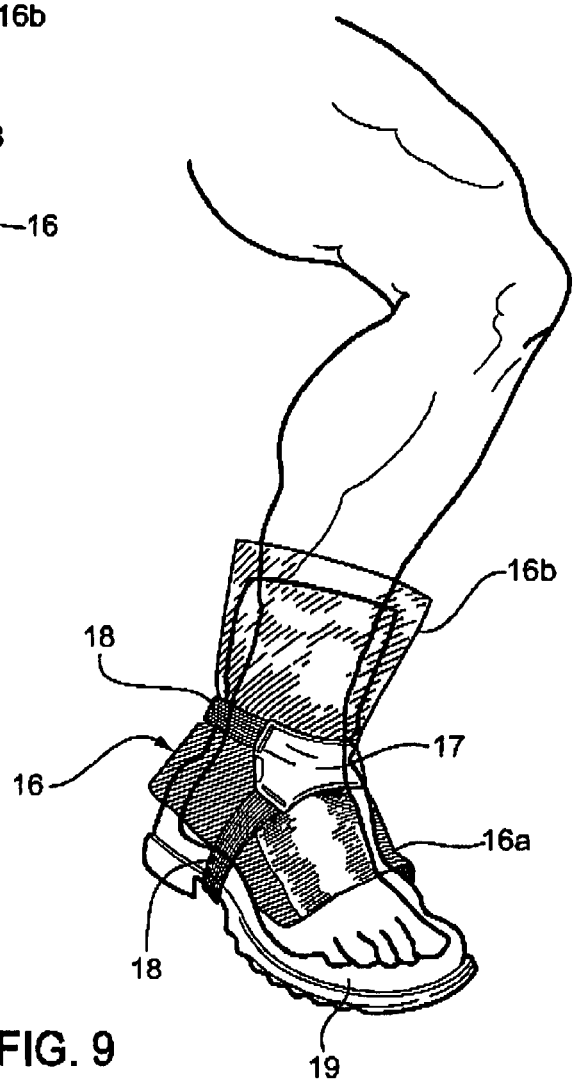

FIG. 5*a* shows the same items as the previous figure, all together, with a helmet;

FIG. 5*b* shows the same items as the previous figure with the flexion possibility of the protected neck highlighted;

FIG. 5*c* shows the same items as FIG. 5*a* in a construction variant;

FIG. 6 shows a protective element for the hand zone according to the present invention in a view from the top;

FIG. 7 shows the same items as the previous figure in a view from the bottom;

FIG. 8 shows a protective element for the foot zone according to the invention;

FIG. 9 shows the same items as the previous figure in the bare legs version.

Figure 1:
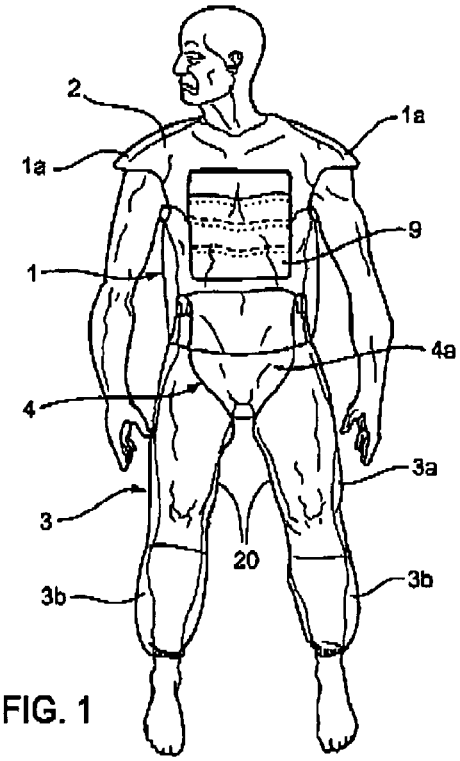
FIG. 1 shows a front view of the complete suit composed of vest and pants and a pelvic protection plate.
Figure 2:
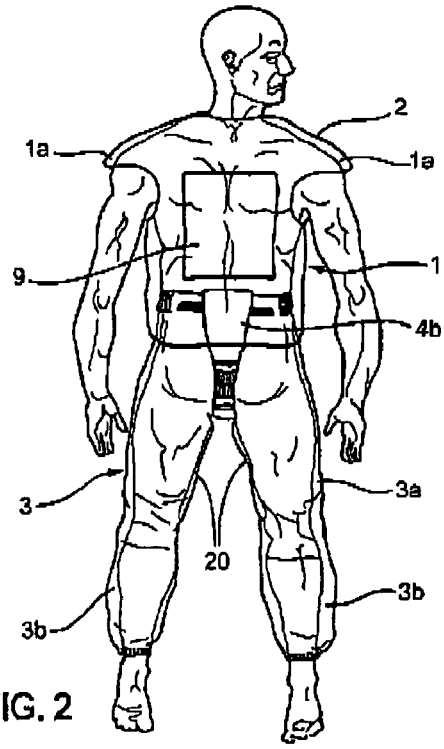
FIG. 2 shows the same items as the previous figure but from a rear view.

In FIGS. 1 and 2, number 1 refers to the vest. The vest presents two upper protrusions 1*a* in correspondence, when the vest 1 is worn, with each of the deltoid muscles. On the upper portion of only one of the two protrusions 1*a* there is a seam 2 machined; the seam 2 comprises a plurality of seams, each one afferent to a group of pluralities of layers of Kevlar® fabric and each one separate with respect to the seams below afferent to the remaining groups of pluralities of the aforesaid synthetic fiber Number 9 refers, in FIGS. 1 and 2, to two removable plates, a frontal one in correspondence with the chest and a rear one in correspondence with the back.

Still in FIGS. 1 and 2, number 3 refers to a pair of pants which present, for each leg, a first portion 3*a* made of Kevlar® and therefore endowed with ballistic properties, and a second portion 3*b* generally endowed solely with fireproof properties and suitable to be tucked into boots 19 as shown in FIG. 8. Each leg of the pant element 3 presents a single seam 20 positioned in correspondence with the internal thigh and extending longitudinally along said pant element.

In FIG. 1 number 4 refers to a protective element 4 constituted of a front portion to protect the pelvic zone 4*a* and a rear portion 4*b* highlighted in FIG. 2. From FIGS. 1 and 2 it can be noted that the protective element 4 is applicable above the pants 3.

Figure 3:
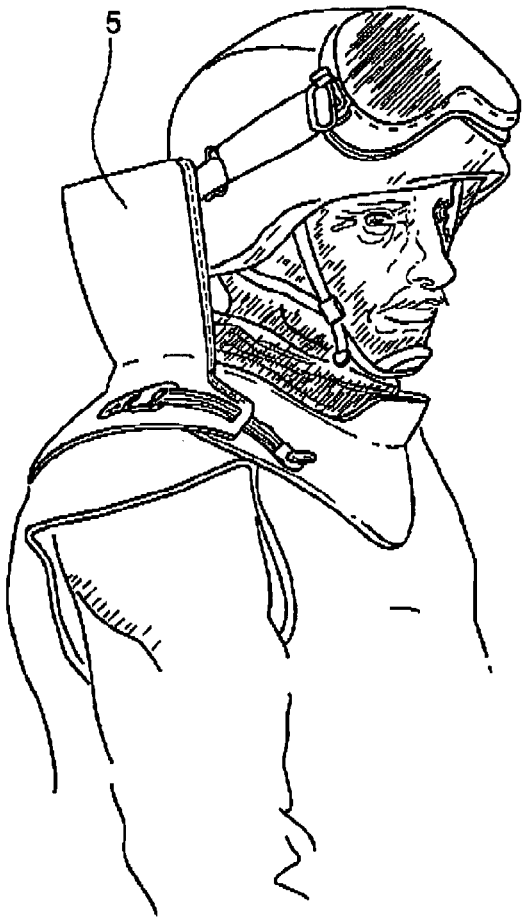
FIGS. 3 and 4 show a protective element for the neck/nape zone according to a known embodiment.
Figure 4:
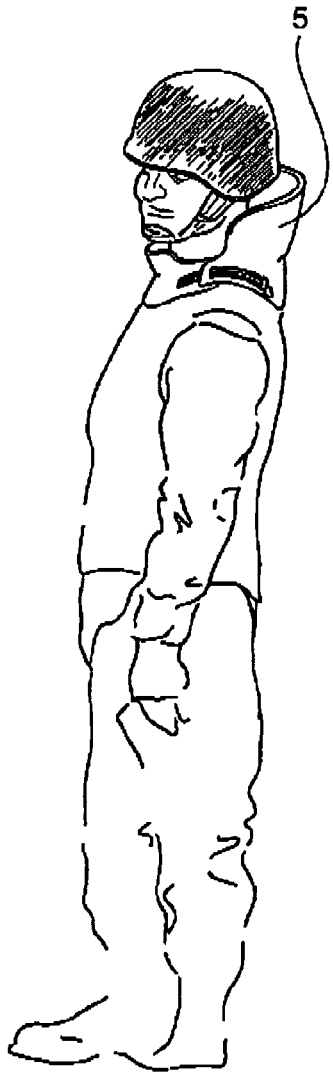

In FIGS. 3 and 4, number 5 refers to a protective element for the neck/nape zone according to a known embodiment.

In FIG. 5, number 6 refers to a protective element for the neck/nape zone according to the present invention. Inside each wing of the element 6 and at the end of each of said wings there is a flat joint element 7 which corresponds with a relative seat in a helmet 8. One variant, shown in FIG. 5*c*, presents a plurality of slits 6*a* in correspondence, at element 6 mounted on the helmet 8, with the ear zone.

With reference to FIG. 6, number 10 refers to the protective element for the hand zone, shaped like a glove. The element presents a first protective portion 11 positioned to protect the index, middle, ring and little fingers, a second protective portion 12 positioned to protect the thumb and third protective portion 13 positioned to protect the wrist zone; the protective portions 11, 12 and 13 are reciprocally connected by means of a fabric portion 14.

The element 10 is fitted with a tiltable portion 15 corresponding to the index finger; said tiltable portion is a fitted with tab 15*a* provided with a strip of Velcro 15*b* suitable to adhere, at the tiltable portion 15 fitted on the relative index finger, to a corresponding strip of 11*a*, also made of Velcro, applied to the lower portion of the element 11 in correspondence with the index finger.

In FIGS. 8 and 9, finally, number 16 refers to a protective element for the foot zone, number 17 is a restraining element to which the two elements 18 for fastening said element to a boot or shoe 19 are integrally restrained. Element 16 presents a first sector 16*a* made of Kevlar® fitted with a protective plate and positioned in correspondence with the foot and a second sector 16*b* generally divest of said protective plate. Said first sector is endowed with antiballistic properties while said second sector is generally only endowed with fireproof properties.

Instead of the traditional stitching on the fabric to increase the ballistic resistance of the clothing, in the present invention, sizing made of a layer of fabric is applied between each layer of Kevlar®; said fabric layer is covered on both sides with non-hardening adhesive material. The sizing, which is applied with heat and pressure, is of the permanent type.

All the elements 1, 3, 4, 6, 11, 12, 13, 16, with the exception of the portions 3*b*, 14 and the second sector 16*b*, are realized by means of five layers made up of five layers of Kevlar®, said total twenty-five layers of Kevlar®. This total number of layers being the minimum suitable to guarantee a protection of up to class III of the United States' NIJ standards for ballistic tests corresponding to protection against fire arms endowed with a speed of up to 426 m/sec.

All the elements of clothing in question in the present invention are endowed with fireproof properties; the two portions 3*b* and the two second sectors 16*b* only present fireproof properties, not antiballistic characteristics.

The protection offered by the clothing in question in the present invention is able to protect the human body for bullet speeds up to the values contemplated by said class III of the NIJ standards, i.e. 426 m/sec, even though, in reality, the tests effected have demonstrated the possibility of the clothing in question in the present invention effectively resisting a bullet speed of approximately 450 m/sec.

In correspondence with the protection zones fitted with armor plates 9 and those positioned in correspondence with the first sector 16*a*, protection classes III/IV of said NIJ standards are reached. In the clothing zones in question in the present invention not covered by the armor plates, the protection reaches said class III of the NIJ standards.

The portion 4*b* performs a protective function for the sacrum-lumbar region in relation to the lower vertebral column against the entrance of splinters via the lower section of the vest element 1.

A further embodiment, not shown, of the clothing in question in the present invention envisages the integral application, inside said clothing, of an underwear body suit in order to guarantee thermal comfort: in this further embodiment, the bulletproof and knife-proof clothing becomes clothing of an isothermal type.

A first advantage offered by the clothing in question in the present invention is constituted, as far as the vest element is concerned, of total protection for the bust, including the sides of this zone, which are covered.

A further advantage of the clothing in question in the present invention is constituted of the high proportion of flexibility, softness and lightness, guaranteeing the wearer ease of movement.

A still further advantage is constituted of the modularity of the clothing: in fact, each of the protective elements can be advantageously utilized independently of all or any of the others depending on the operative needs.

The invention claimed is:

1. Clothing endowed with bulletproof and knife-proof properties of the type realized by means of the employment of a para-aramid synthetic fiber material together with armor plates, characterized by the fact that said clothing comprises:

a vest element (1) fitted with two armor plates (9), one at the front and one at the rear, and fitted with a lateral extension of the vest which also continues in correspondence with the lateral portions of the bust; said vest element also being fitted with two protrusions (1*a*), each one positioned in correspondence with a shoulder; said vest element having a single seam line (2);

a pant element (3), said pant element being endowed with a single seam (20) for each leg;

a protective element (4) composed of a front portion (4*a*) to protect the ventral and genital zone and a rear portion (4*b*) to protect the sacrum-lumbar zone; a protective element for the neck/nape zone (6) that can be constrained to a helmet (8);

protective elements (11,12,13) for the hand zone;

protective elements for the foot zone (16) fitted with armor plates in at least one first sector (16*a*) which covers and wraps the foot; and the fact that the para-aramid synthetic fiber material fabric is subdivided into several groups of pluralities of layers; said elements of clothing constitute a modular clothing system as they can all be used contemporaneously or only partially, depending on the different operative requirements, and each protective element (1, 3, 4, 6, 11, 12, 13, 16) is divest of stitching, the latter being replaced by sizing made of a thin layer of fabric covered on both sides with non-hardening adhesive material; said sizing, which is applied with heat and pressure, being of the permanent type.

2. Clothing according to claim 1, characterized by the fact that the seam (2) is machined onto the upper portion of only one of the two protrusions (1*a*).

3. Clothing according to claim 2, characterized by the fact that each protrusion (1) extends towards the exterior to protect, when the vest is worn, the respective deltoid muscles.

4. Clothing according to claim 1, characterized by the fact that the single seam (20) on each leg is positioned in correspondence with the inner thigh and extends longitudinally along the pant element (3).

5. Clothing according to claim 2, characterized by the fact that the protective elements for the hand zone (11, 12 13) are applied to a glove-shaped element (10).

6. Clothing according to claim 5, characterized by the fact that the element (10) is fitted with a tiltable portion (15) corresponding to the index finger; said tiltable portion being fitted with a tab (15*a*) provided with a strip of hook and loop fastening material 15*b* suitable to adhere, at the tiltable portion (15) fitted on the relative index finger, to a corresponding strip (Ha), also made of hook and loop fastening material, applied to a lower portion of the element (11) in correspondence with said index finger.

7. Clothing according to claim 1, characterized by the fact that a rear portion (4*b*) performs a protective function for the sacrum-lumbar region in relation to the lower vertebral column against the entrance of splinters via the lower section of the vest element (1).

8. Clothing according to claim 1, characterized by the fact that the two armor plates (9) and the armor plates located in the first sector (16*a*) are realized with boron carbide.

9. Clothing according to claim 1 characterized by the fact that all the protective elements are endowed with fireproof properties.

10. Clothing according to claim 1, characterized by the fact that an underwear body suit can be applied integrally to said clothing in correspondence with the internal part of said clothing facing the body; said underwear body suit being suitable to guarantee the wearer thermal comfort.

* * * * *